United States Patent [19]

Ikuo et al.

[11] 4,452,019

[45] Jun. 5, 1984

[54] ANTISEISMIC REINFORCEMENT METHOD FOR AN EXISTING BUILDING WITH A CONCRETE BLOCK SYSTEM

[75] Inventors: Yamaguchi Ikuo; Higashibata Yasuo; Fujimura Masaru; Nagashima Toshio, all of Tokyo; Sugano Shunsuke, Yokohama, all of Japan

[73] Assignee: Takenaka Komuten Co., Ltd., Osaka, Japan

[21] Appl. No.: 147,364

[22] Filed: May 7, 1980

[51] Int. Cl.[3] ..... E04B 1/98; E04H 9/02

[52] U.S. Cl. ..... 52/167; 52/240; 52/252; 52/293; 52/438; 52/439; 52/583; 52/747

[58] Field of Search ..... 52/1, 167, 439, 438, 52/231, 240, 655, 657, 695, 747, 252, 259, 293, 583

[56] References Cited

U.S. PATENT DOCUMENTS

| | | | |
|---|---|---|---|
| 1,953,154 | 4/1934 | Cram | 52/439 X |
| 2,498,276 | 2/1950 | Kany | 52/438 |
| 3,842,558 | 10/1974 | Scholz et al. | 52/293 |

FOREIGN PATENT DOCUMENTS

| | | | |
|---|---|---|---|
| 1049332 | 1/1959 | Fed. Rep. of Germany | 52/590 |
| 1380511 | 10/1964 | France | 52/259 |
| 52-45141 | 4/1977 | Japan | 52/167 |
| 584194 | 1/1947 | United Kingdom | 52/231 |
| 397617 | 2/1974 | U.S.S.R. | 52/167 |
| 512279 | 6/1976 | U.S.S.R. | 52/167 |
| 555209 | 5/1977 | U.S.S.R. | 52/167 |
| 571561 | 9/1977 | U.S.S.R. | 52/167 |
| 620567 | 8/1978 | U.S.S.R. | 52/167 |
| 658250 | 4/1979 | U.S.S.R. | 52/259 |

*Primary Examiner*—Alfred C. Perham
*Attorney, Agent, or Firm*—Eric P. Schellin

[57] ABSTRACT

A method of achieving earthquake reinforcement in existing buildings by piling hourglass-shaped concrete blocks within a beam pillar frame structure of a wall. The blocks are piled by staggering by half one pitch of the layer of concrete blocks and by filling the whole area within the beam pillar frame. The blocks are provided with stud plates that are welded to supporting bands which are in turn connected to the frame.

4 Claims, 10 Drawing Figures

ANTISEISMIC REINFORCEMENT METHOD FOR AN EXISTING BUILDING WITH A CONCRETE BLOCK SYSTEM

SUMMARY OF THE INVENTION

This invention relates to an earthquake-resistant reinforcement method to increase antiseismicity for an existing reinforced concrete building.

The method according to the invention aims at achieving earthquake resistant reinforcement for an existing reinforced concrete building by piling concrete blocks of a specific shape and having an exposed end stud plate within the beam-pillar structure thereof by staggering by half one pitch the layer of concrete blocks and by filling the whole area within the beam-pillar structure frame and fixing the concrete blocks providing supporting bands vertically and horizontally at the front and the back of the said beam-pillar struxcture and by welding to each of the stud plates.

DETAILED DESCRIPTION OF THE INVENTION

The object of the present invention is to offer a highly effective, economical reinforcement method against earthquakes which is easy to apply in practical application for the existing reinforced concrete buildings which have been known to be unstable and which have been known to lack in the earthquake resistance, thereby to avoid the disadvantages of demolishing and re-building such buildings.

The another object of the present invention is to offer an earthquake-resistent reinforcement method by piling concrete blocks of a specific shape and having an exposed stud plate throughout the entire area of the beam-pillar structure, fixing the layers of concrete blocks providing supporting bands vertically and horizontally at the front and the back of the beam-pillar structure and by welding these bands to the stud plates.

The above objects of the present invention will become more easily understood from the following description made in reference to the embodiments of the present invention and the appended drawings.

Figure 1:
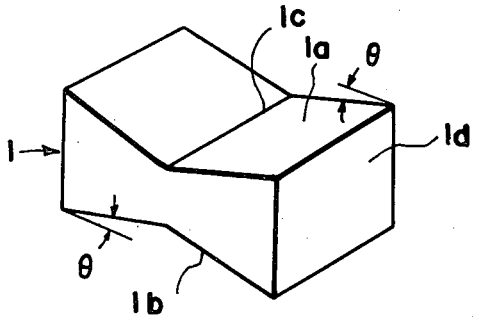
FIG. 1 is a perspective view of one embodiment of a concrete block used in practical application of the present invention.

The concrete block shown in FIG. 1 is formed by depressing the upper and lower surfaces of a rectangular prisms 1*a* and 1*b* of about 300 mm in width, about 150 mm in height and about 150 mm in depth at the center of the longitudinal side 1*c* so as to have symmetrical sloped surfaces horizontally the depression being at the largest depth at the center, and vertically, as shown in the figure.

Figure 3:
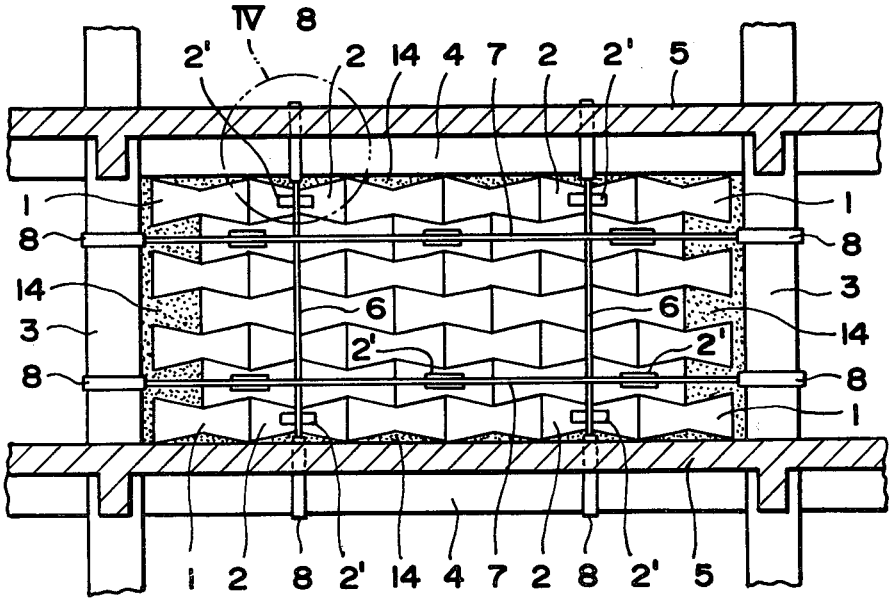
FIG. 3 is a front view of the main parts of the embodiment of the reinforcement for the existing reinforced concrete building using concrete blocks shown in FIGS. 1 and 2.

The inclination angle $\theta$ is generally less than 30°, for instance 10°–15°, or an angle sufficient to act as a wedge to prevent horizontal displacement among the concrete blocks when they are piled (the horizontal displacement in FIG. 3).

Figure 2:
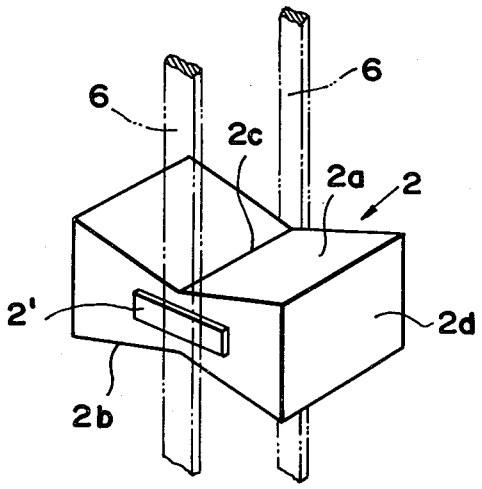
FIG. 2 is a perspective view of another embodiment of a concrete block according to the present invention in actual use.

The concrete block shown in FIG. 2 has a shape with rectangular prisms 2*a* and 2*b* similar to the one shown in FIG. 1, but it further comprises plates 2' of weldable material, for instance of stainless steel, which is embedded in and exposed from on the front and the back surfaces. When concrete blocks of this type are piled up in the pillar-beam frame structure, the plates are welded to supporting bands of weldable material, for instance of steel plate, provided on both sides of the frame structure in order to support the concrete blocks.

FIG. 3 shows an earthquake-resistent reinforcement method wherein concrete blocks of FIG. 1 are used with a suitable number of the concrete blocks of FIG. 2. The concrete blocks are laid in the following manner. First, concrete blocks 1 or 2 are laid in a linear fashion immediately on and along the lowest beam of the pillar-beam frame structure, a side face 1*d* of a block contacting closely with a side face of another block[1] or with a side face 2*d* of a block[2] to stretch fully in a row between the pillars at both sides 3 and 3 . . .

Figure 4:
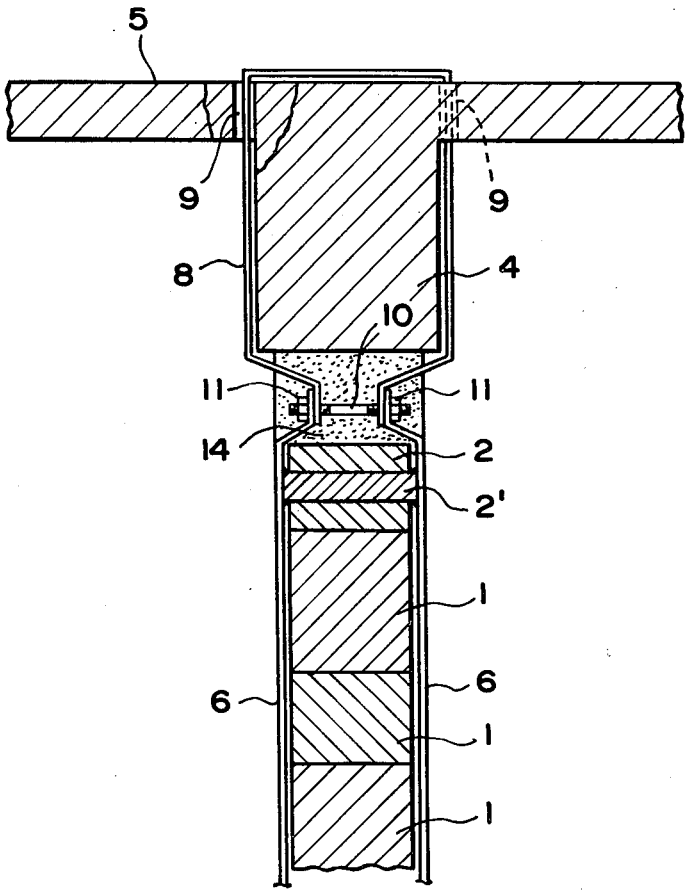
FIG. 4 is a cross sectional view of the portion designated by IV and enlarged in the side of FIG. 3.
Figure 5:
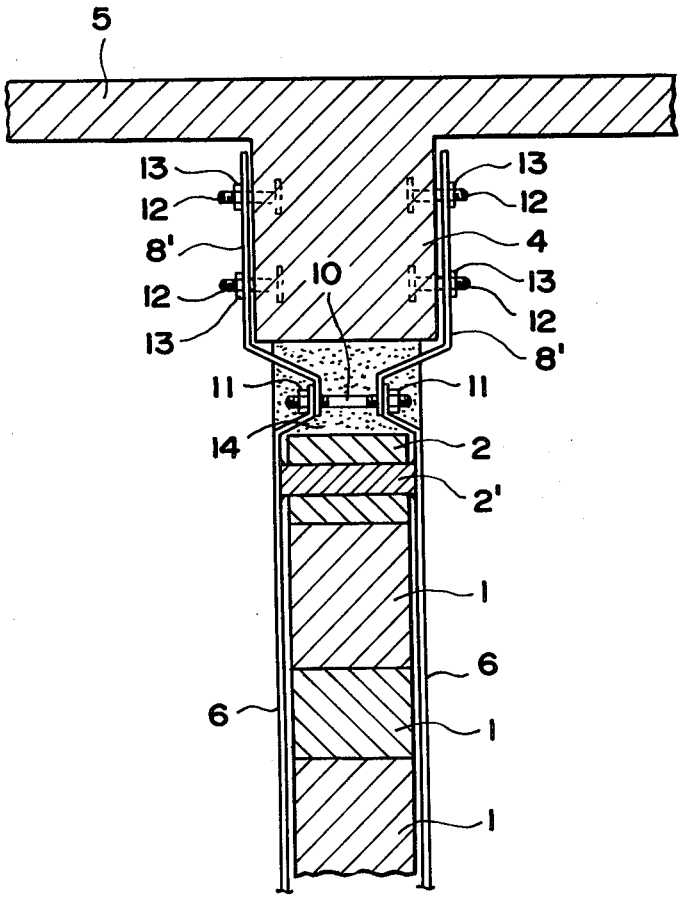
FIG. 5 is an enlarged cross sectional view showing an alternate construction for the portion IV of FIG. 3.

As for the second layer, concrete blocks 1 or 2 are piled on the concrete blocks piled at the first layer in a staggering manner by one half pitch so that a side face 1*d* of a concrete block 1 closely contacts with a side face 1*d* of another concrete block 1 or with a side face 2*d* of a concrete block 2 immediately upon the central and lowest ridgeline of a concrete block laid at one layer below to finally stretch fully between the right and left pillars 3 and 3. Concrete blocks are piled up in the similar manner until the structure reaches substantially the highest beam 4, forming a wall of concrete blocks inside the pillar-beam frame structure. Consequently, a plural number of support bands 6, 6 and 7, 7 are arranged both horizontally and vertically on the front side and back side faces of the wall so as to align with the locations of the concrete blocks 2 having the embedded plates 2' and welded thereto. The both ends of the support bands are connected either to a beam 4 or a pillar 3 according to the method of which details are shown in FIG. 4. Finally, mortar 14 is compactly filled into the clearance between the piled concrete blocks 1 and 2 and the pillars 3, 3 and the beams 4, 4 which constitute the pillar-beam frame structure to substantially integrate the same as one wall. The upper ends of support bands 6, 6 arranged at front and back faces of piled-up concrete blocks 1 and 2 are coupled to both ends of a coupling band plate 8 which is wound around a beam 4 with a common bolt 10 and nuts 11 and 11. The coupling band plate 8 is wound around the beam 4 through openings 9 and 9 which are provided on a slab 5 at positions aligned with the winding positions. An end of a support band 7 can be coupled with a pillar 3 with the use of a coupling band plate 8 in a manner similar to the case shown in FIG. 4; however, the openings are not necessary unless the pillar is the one connected to a wall. FIG. 5 is another embodiment of the method to connect the end of a support band 6 to a beam 4 wherein upper ends of two band plates 8' and 8' are fixed on a beam 4 by a stud bolt 12 implanted on the beam and nut 13 and the coupling band plates 8' and 8' and the support bands 6 and 6 are connected to each other with a common bolt 10 and nuts 11 and 11. An end of a support band 7 can be connected to a pillar 3 in a similar manner. As a coupling band plate 8 and 8', tensile materials having a suitable flexibility, for instance, a steel band plate is used.

According to the earthquake-resistent reinforcement method shown in FIG. 3, concrete blocks 1 and 2 are securedly supported by the support bands 6 and 7 so as not to be moved or displaced by external surface traction caused during earthquakes and further fixed solidly with the hardening of the mortar therearound so as to form a wall integral to the pillar-beam frame structure. Therefore, the pillar-beam frame structure of the present invention can effectively resist a shearing strain with the wedge effect caused by abutment between concrete block layers, thus obtaining stronger resistance against seismic force which might affect the pillar-beam frame structure. If the above-described reinforcement is added to all or necessary pillar-beam frame structures of an existing reinforced concrete building, the earthquake-resistance and safety of the building are increased to be a reliable degree for practical purposes.

Figure 6:
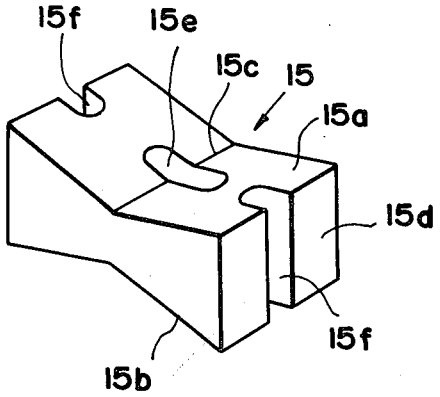
FIG. 6 is a perspective view showing another embodiment of the concrete block used in the practical application of the present invention.

The concrete block 15 shown in FIG. 6 has a basically similar shape to those 1 and 2 shown in FIGS. 1 and 2, but is provided with an oblong orifice **15*e* of which longer diameter extending in the horizontal direction of the concrete block at the center line 15*c* of the sloped upper and lower faces 15*a* and 15*b*, the orifice vertically penetrating through the concrete block. The concrete block 5 is further provided with two grooves of U-shape 15*f* and 15*f* of which size equals to one half of the said oblong orifice at the center of the both side faces 15*d* and 15*d***. The width of the orifice and of the U-shaped groove is determined so that the reinforcement bars or coupling bars which will be described later can be passed therethrough and that it is suitable to be filled with mortar.

Figure 8:
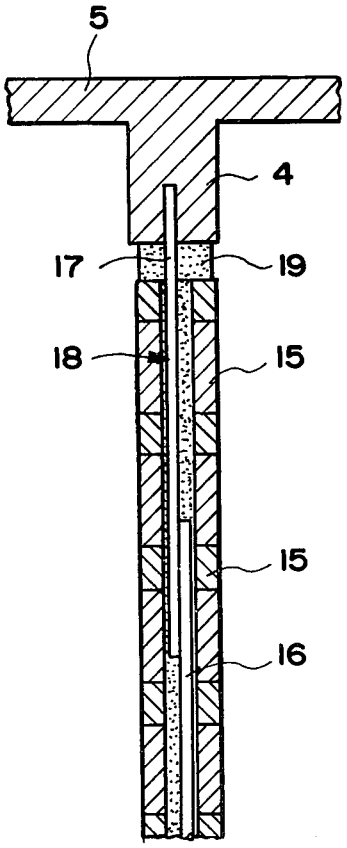
FIG. 8 is a cross sectional view along the line VIII—VIII of FIG. 7.
Figure 7:
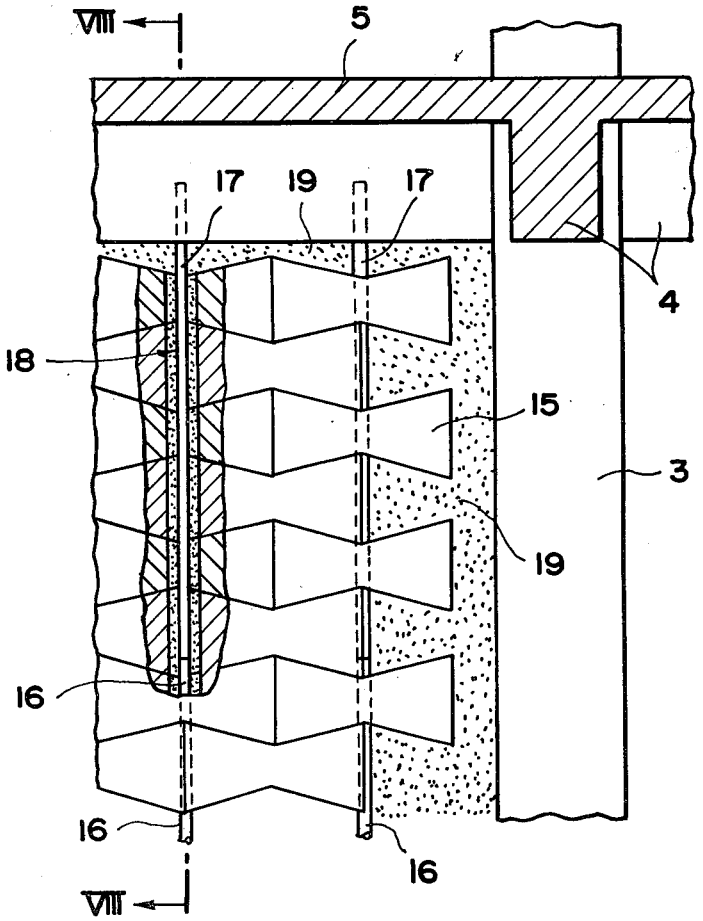
FIG. 7 is a front view showing the main part of the reinforcement method for the existing reinforced concrete building for earthquake resistance using the concrete blocks of FIG. 6.

The earthquake-resistent reinforcement method shown in FIGS. 7 and 8 comprises a step of piling concrete blocks 15 inside a pillar-beam frame structure to form a wall in a manner similar to the one shown in FIG. 3, and a step of passing a reinforcing bar 16 and a coupling bar 17 from a slab 5 to the lower face of the highest beam 4 continuously through a hole which is formed vertically and penetratingly in the piled concrete block by aligning the said oblong orifice perforated at the center of each concrete block with an orifice formed at either one layer below or one layer above the concrete block by joining the said U-shaped grooves of two adjacent concrete blocks 15 and 15. The reinforcing bar 16 and the coupling bar 17 may be passed through oblong orifices **15*e* and U-shaped grooves 15*f* of all concrete blocks or oblong orifices 15*e* and U-shaped grooves 15*f* at positions necessary for reinforcement of the wall of concrete blocks against external surface force. The method comprises fixing the lower end of the reinforcing bar 16 to a slab or the like by implanting the same or other means in advance, and penetrating a concrete block through the oblong center orifice 15*e* . . . or the U-shaped groove 15*f* . . . thereof as it is piled up in a layer. The upper end of a coupling bar 17, on the other hand is fixedly studded at a suitable location on the lower face of the highest beam of the frame structure, is made to penetrate through the oblong orifice 15*e* of the U-shaped groove 15*f* through which the reinforcing bar has already been passed so that a desirable length thereof comes to superpose above the reinforcing bar upper end. Accordingly, after piling up concrete blocks in layers as a wall to reach the highest beam 4, mortar 18 is compactly filled in the oblong orifices 15*e* and U-shaped grooves 15*f* through which the reinforcing bars 16 and coupling bars 17 penetrate so as to integrally connect the reinforcing bars 16 to each concrete block 15 and to couple the reinforcing bars 16 and the coupling bars 17. Mortar 19 is further filled in the clearance between the concrete blocks and the pillar 3, 3, the beam 4 or the slab 5**, thus constructing a wall of piled and fixed concrete blocks.

According to the earthquake-resistent reinforcement method described with reference to FIGS. 7 and 8, concrete blocks 15 . . . are restricted by the reinforcing bars 16 and the coupling bars 17 so as not to be moved or displaced by the external surface traction generated by the earthquakes and are further formed integrally with the pillar-beam frame structure by the surrounding mortar 19. Therefore, even if it met the seimic force generated during the earthquakes, the structure can effectively resist the shearing displacement thereof by the reinforcement effect imparted by the said reinforcing bars and by the wedge effect produced by abutment between layers of concrete block 15, 15. If such earthquake-resistent reinforcement is applied to all or necessary pillar-beam frame structures of an existing reinforced concrete building, the earthquake-reistance of the building can still be increased, thereby obtaining safety and reliability in practical use.

Figure 9:
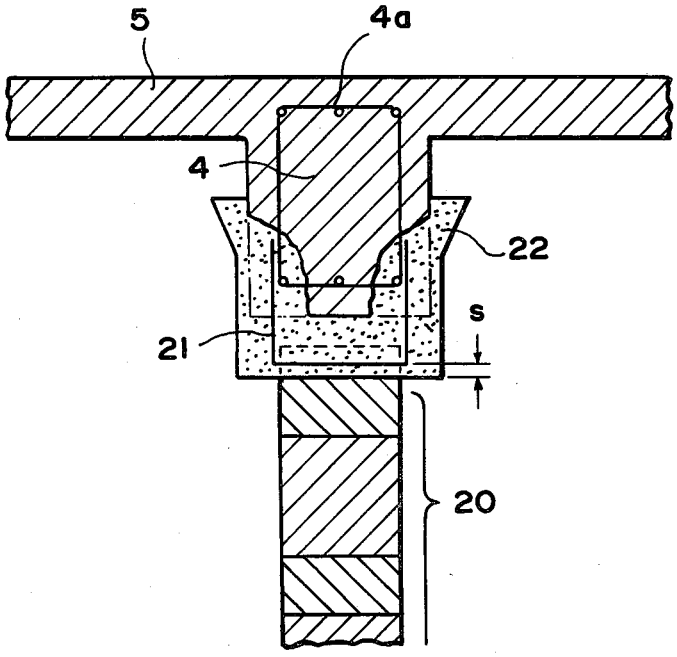
FIG. 9 is a vertical cross sectional view showing an integrating method for the piled concrete blocks piled within the beam-pillar structure frame and the beams with in-situ concrete pouring.
Figure 10:
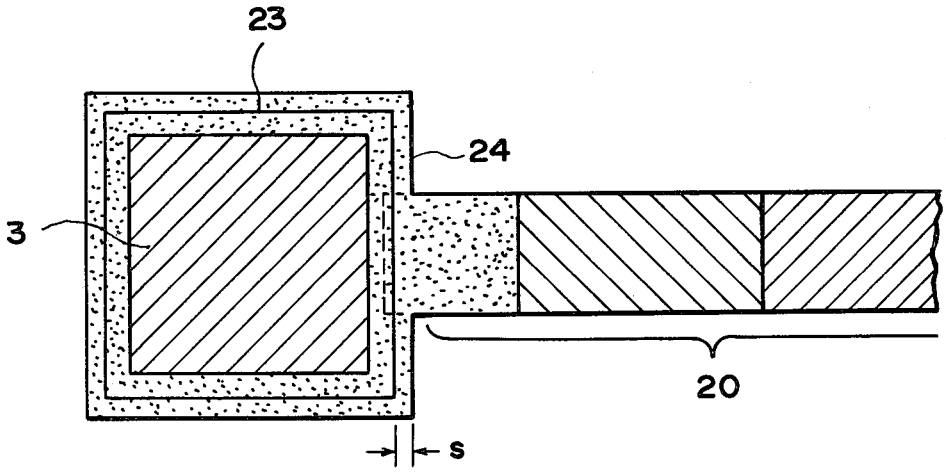
FIG. 10 is a horizontal cross sectional view showing an integrating method for the concrete blocks piled within the beam-pillar structure frame and the beams with the in-situ concrete pouring.

FIG. 9 shows a reinforcement method to substantially integrate a wall 20 with a upper beam 4 comprising a pillar-beam frame structure by fixing the same with cast-in-place concrete, the wall being formed by the methods described with reference to FIG. 3 or FIG. 6 or by piling concrete blocks alone 1, 2 or 15 of one type or more than two types in combination. The method comprises a step of removing extensively the lower portion of both side faces of the beam 4 so as to expose the lower portions of the reinforcing bar **4*a* at both sides, a step of arranging a U-shaped reinforcing stirrup which overlaps the hoop of the exposed reinforcing bar 4*a*, a step of making the horizontal member of the said reinforcing stirrup 21 retain a desirable distance s from the highest face of the wall 20 for protective concrete covering and a step of installing the said reinforcing stirrups 21 in a plural number in a direction perpendicular to the cross sectional view shown in FIG. 9 at a predetermined pitch, for instance, at a pitch where a stirrup comes upon every central ridge line of the concrete blocks 1*c*, 2*c* or 15*c*. Then cast-in-place concrete is poured into the forms assembled along the configuration of the cross-section shown in FIG. 9 so as to compactly fill the clearance between the wall 20 and the beam 4, thereby integrating and fixing the wall 20 with the beam 4 as well as reconstructing the beam 4. FIG. 10** shows a reinforcing method to substantially fix a wall 20 made by piled up concrete blocks to a pillar 3 comprising a pillar-beam frame structure with cast-in-place concrete. In the above method, a plural number of reinforcing hoops 23 is concentrically provided at a desirable pitch on the outer circumference of the pillar 3 in a direction perpendicular to the view shown in FIG. 10 and the hoops are made to retain a desirable distance from the side face portion of the wall 20 for a protective concrete covering. Then, cast-in-place concrete is poured into the forms assembled along the outer circumference of the pillars 3 so as to compactly fill the clearance between the wall 20 and the pillar 2 and the clearance outside the outer circumference of the pillar 3, thereby fixedly integrating the wall to the beam 4. Although the pillar 3 shown in FIG. 10 is of the type where walls are not connected thereto, reinforcement against earthquake is readily applied to the type where walls are connected thereto by providing an opening on the wall through which a reinforcing hoop 23 can be passed.

In the earthquake-resistent reinforcement method described in FIGS. 9 and 10, the reinforced pillar-beam frame structure can more effectively resist seismic force since cast-in-place concrete directly transmits the force to the wall 20 which effectively resists the shearing displacement with the wedge effect produced by abutment among concrete blocks. Therefore, if such reinforcement is applied to all or necessary pillar-beam frame structures of an existing reinforced concrete building, the earthquake-resistance of the building is increased, thereby obtaining the safety and the reliability in practical use.

What is claimed for:

1. An antiseismic reinforcement structure for a building comprising:

(a) concrete blocks provided with sloped areas extending from the edges along the width and meeting at the horizontal center of a longitudinal side thereof on both top and bottom faces so as to form slopes symmetrical horizontally and vertically at the center thereof, said concrete blocks being laid in a manner such that side faces of the concrete blocks contact closely to each other and said concrete blocks laid in the above described manner being piled in layers such that two of said blocks horizontally abut each other immediately above a central ridge line of another concrete block laid in a layer immediately below a layer occupied by said horizontally abutting blocks;

(b) stud plates attached to vertical faces of some of said concrete blocks; and (c) support bands arranged both horizontally and vertically on front and back faces of the building's pillar and beam structure to be welded to said stud plates with both ends of said support bands being connected to said pillar and beam structure whereby a wall is formed which is integral with said pillar and beam frame structure.

2. An antiseismic reinforcement method for existing buildings by piling concrete blocks inside and throughout the whole area of a pillar-beam frame structure for forming a wall which is integral with the pillar-beam frame structure comprising piling concrete blocks whose longitudinal sides are at the top and the bottom indented toward the center thereof to form slopes vertically and horizontally symmetrical with respect to the height of the individual blocks and piling other concrete blocks whose longitudinal sides at the top and the bottom are indented toward the center thereof to form slopes vertically and horizontally symmetrical with respect to the height of the individual blocks and are also provided with exposed stud plates on their vertical faces in a combination at a suitable ratio to form a wall member and in layers such that two of said blocks horizontally abut each other immediately above a central ridge line of another concrete block laid in a layer immediately below a layer occupied by said horizontally abutting blocks; providing supporting bands vertically and horizontally at the front and the back of said wall member; welding the supporting bands with the stud plates in abutment therewith; connecting the supporting bands in the horizontal direction at both ends thereof with a coupling band plate wound to the pillars; and connecting the supporting bands in the vertical direction at both ends thereof with a coupling band plate wound to the beams in order to integrally connect the wall member with the pillar-beam frame structure.

3. An earthquake-resistant reinforcement method as claimed in claim 2 comprising further filling mortar the clearance between the pillars or the beams and the concrete blocks laid and piled all over the pillar-beam frame structure.

4. An earthquake-resistant reinforcement method as claimed in claim 2 further comprising integrating the concrete blocks piled and laid inside the pillar-beam frame structure and the pillars and the beams with cast-in-place concrete.

* * * * *